US005309597A

United States Patent [19]

Wymore

[11] Patent Number: 5,309,597

[45] Date of Patent: May 10, 1994

[54] POWERED ENDLESS BELT BRUSH

[76] Inventor: Roger S. Wymore, 4612 F Ave. NE., Cedar Rapids, Iowa 52402

[21] Appl. No.: 89,619

[22] Filed: Jul. 12, 1993

Related U.S. Application Data

[63] Continuation-in-part of Ser. No. 788,773, Nov. 6, 1991, abandoned.

[51] Int. Cl.[5] ..... A46B 13/02; A47L 11/24

[52] U.S. Cl. ..... 15/22.3; 15/4; 15/49.1; 15/80; 15/179; 15/183

[58] Field of Search ..... 15/22.3, 49.1, 51, 48, 15/80, 97.1, 344, 41.1, 99, 93.1, 4, 179, 183

[56] References Cited

U.S. PATENT DOCUMENTS

| | | | |
|---|---|---|---|
| 3,368,231 | 2/1968 | Kravos et al. | 15/344 |
| 3,872,539 | 3/1975 | Doyel | 15/344 |
| 4,209,870 | 7/1980 | Doyel | 15/22.3 |
| 4,799,281 | 1/1989 | Sandstrom | 15/80 |
| 4,914,773 | 4/1990 | Ham | 15/84 |

FOREIGN PATENT DOCUMENTS

| | | | |
|---|---|---|---|
| 610351 | 10/1960 | Italy | 15/80 |

*Primary Examiner*—Edward L. Roberts

[57] ABSTRACT

A hand held device for sweeping cloth and other surfaces and to convey the sweepings to a self-contained dust pan. An endless flat belt rotating on two pulleys of unequal diameter supports a plurality of transverse brushes which do the sweeping and conveying. Rotation is derived from a motor contained within the larger pulley. The motor is driven by direct current batteries when the operator presses a switch in the handle. The smaller pulley resides near an opening in the housing. The brushes, one after another sweep through the opening picking up any residues on the surface being brushed and conveys them onto a flat surface which is parallel to the conveying leg of the belt. This plate cooperates with the brushes to convey the particles of residue to the center of the dust pan. Gravity traps the particles beneath the conveying plate in the dustpan until dumping is accomplished. The brushes continue on through a comb, on around the main pulley and back to the opening for another stroke. The residues are dumped by the operator placing the unit over a waste receptacle with the opening up and rotating the dust pan to the open position. The pan pivots about the axis of the small pulley. A storage receiver stores the unit and recharges the batteries.

4 Claims, 3 Drawing Sheets

POWERED ENDLESS BELT BRUSH

This application is a continuation-in-part of application Ser. No. 07/788,773, filed Nov. 6, 1991, now abandoned.

BACKGOUND—FIELD OF INVENTION

This invention incorporates a powered, endless belt to which are attached an assortment of brushing and scraping tools which loosen particles of dust and debris from cloth and other surfaces and convey the refuse to an integral receiver.

BACKGROUND—DESCRIPTION OF PRIOR ART

Heretofore, prior art has identified several powered means for the pickup and containment of loose materials considered to be soil or litter. These are:

1. air movers, or those machines making use of high velocity air movement created by mechanically causing a partial vacuum to exist somewhere in the system;
2. manual cylinder brushing machines such as the carpet sweeper;
3. endless belts which have scrapers attached for doing work such as removing snow from a surface.

Vacuum cleaners have been the cleaning appliance of choice over the past 70 years. Wherever electricity was available it was generally the most effective method of cleaning cloth and carpeted surfaces. The addition of the cylindrical brush and beating bar was effective in loosening soil from the material being cleaned. Unfortunately, vacuums are very energy-dependent requiring high speed to be effective. The better machines are incorporating a separate motor to run the brush and bar appliance allowing the high speed power to do the conveying via the high velocity movement of air. Speed generates noise, as a rule, and the vacuum sweeper is at the top of the list of noise makers.

Although there are attempts at powering hand-held units with batteries, they are not very efficient. To render them really effective would mean adding brushes of some sort, such larger motors and heavier batteries. The latter would be counter-productive.

There are areas where a vacuum is ineffective. The vacuum works by moving air from a nozzle through a filtering bag. It must do this at a high enough velocity to involve the target debris. If that debris is larger than the path tubes and nozzles, then clogging can and does occur. Increasing the passage cross-sectional area decreases velocity of air movement thus decreasing effectiveness for smaller, heavier objects. Consequently there are a lot of cleaning jobs where vacuum machines are impractical. For instance, in order to pick up something the size of a ping pong ball, a vacuum machine would be the last choice.

The carpet sweeper has been around for much longer than the vacuum sweeper. It has maintained a position in the marketplace in spite of the more efficient vacuum cleaner. On its behalf, it is quiet and, since it requires no electricity, is quick to use for small, dry spills of fine materials. And, it contains its own receivers. U.S. Pat. No. 4,823,422 to Yoshamura and Ishel of Japan was recently issued on a manual floor sweeper (1989). The carpet sweeper requires such energy from the operator and is only efficient for covered floor surfaces. As with the rotating brush of vacuum cleaners, these have the tendency to wrap up thread or string on the roller. If attached to anything it must be removed before continuing. Also, they will not clean horizontal corners such as a walls and around table legs.

The endless belt has been around for countless years as a means for transmitting power and conveying materials from one point to another. Only in more recent years has it been used in alternate ways. Two machines are available that make use of working endless belts. One is the well-known belt sander and the other is a recently patented Snow Blow With Vertical Endless Belt Digger issued to Cloutier in 1988, U.S. Pat. No. 4,765,073.

The sander cleans surfaces by removing integral particle from the surface to which applied. The belt also is integrated with the parts doing the actual work. A belt strand is always parallel with the work surface therefore, as will be seen, this machine is not similar in any way to this invention other than using an endless belt.

The snow blower incorporates an endless belt with transverse appliances referred to as diggers. The verticality of the belt strands is most necessary to the machine as it is the intent to accelerate the particles being conveyed upward and hurl them a distance forward and away from the machine. By the very nature of snow, it would be impractical to attach a container of any kind. Power requirements are significantly different being on the order of 250 times more than the machine being described herein. It is fitted with a rubber belt of some thickness and the resulting stiffness requires a great deal of power to drive. Of course, the weight of the snow produces the main work.

The endless belt snow blower configuration is designed strictly for cleaning of snow from a horizontal surface and would work in no other capacity. The belt strands operate solely in vertical planes and the digging appendages stand out rigidly in perpendicular directions from the strands of the belt. Again it will be seen that this machine has little in common with this invention other than incorporating an endless belt.

It is my purpose to show I have invented a basic mechanism for the brushing and sweeping activities for interiors of the home as well as surfaces restaurants, will find this machine quiet and very effective. Further, it will be shown that this tool will remove many of the disadvantages of the aforementioned implements and include some additional advantages and conveniences.

OBJECTS AND ADVANTAGES

Accordingly several objects and advantages of the powered endless belt brush are:

(a) device using less power than a 25-watt light bulb allowing rechargeable battery power and requiring no cords;

(b) a very quiet device which can be used continually in areas where the noise of a vacuum sweeper can become disruptive;

(c) a device with the power to pick up nuts and belts as well as spills of nails, metal shavings and solid food particles;

(d) a device with a mouth large enough to accept items the size of a ping pong ball;

(e) a device that can remove paint and rust scale when fitted with steel bristles, emery cloth or sandpaper;

(f) a device with the delicacy to brush dust from a suit of clothing, furniture and walls;

(g) a device where air movement is still involved and aids in the process of dust particle removal without the involvement of a vacuum; and, (h) a device which when fitted with an integral dust pan can be emptied simply and quickly into a trash receiver, requiring no additional bag of any kind;

(i) devices which can be very light in weight allowing the operator to support the units tirelessly when cleaning.

(j) devices which can be stored on walls requiring no use of critical floor space.

Further objects and advantages of my invention will become apparent from a consideration of the drawings and ensuing description.

DESCRIPTION OF INVENTION

Figure 3:
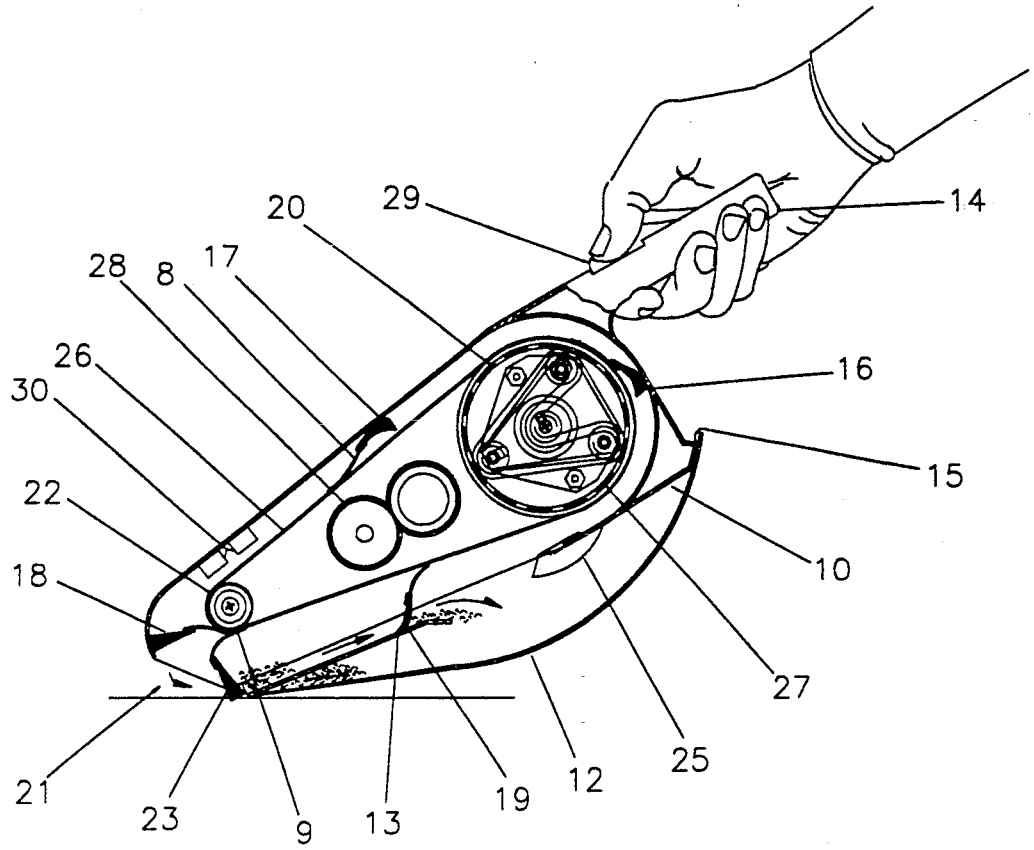
FIG. 3 shows a broken-out side view of the FIG. 1 brush in position and cleaning a horizontal surface.

FIGS. 1 through 5 give a complete picture of a powered endless belt brush. There are two sides to the housing, one left 10 and one right 11. They are injection molded and each is integral with half of the handle. The handle 14 houses the, detent-on, momentary on-off switch 29 similar to that of a flashlight. All electrical circuitry is contained within the right housing 11. The two halves meet, tongue and grooved, at the longitudinal centerline lying in a plane parallel with planes containing the edges of the endless belt 26. The halves are held together with removable screws on raised bosses. The dust pan 12 shares center of rotation with the lower driven pulley 22. A simple catch spring 15 is located centrally of the pan near the opening lip. Suitable cloth-type or sponge-type seals keep leakage to a minimum.

Figure 10:
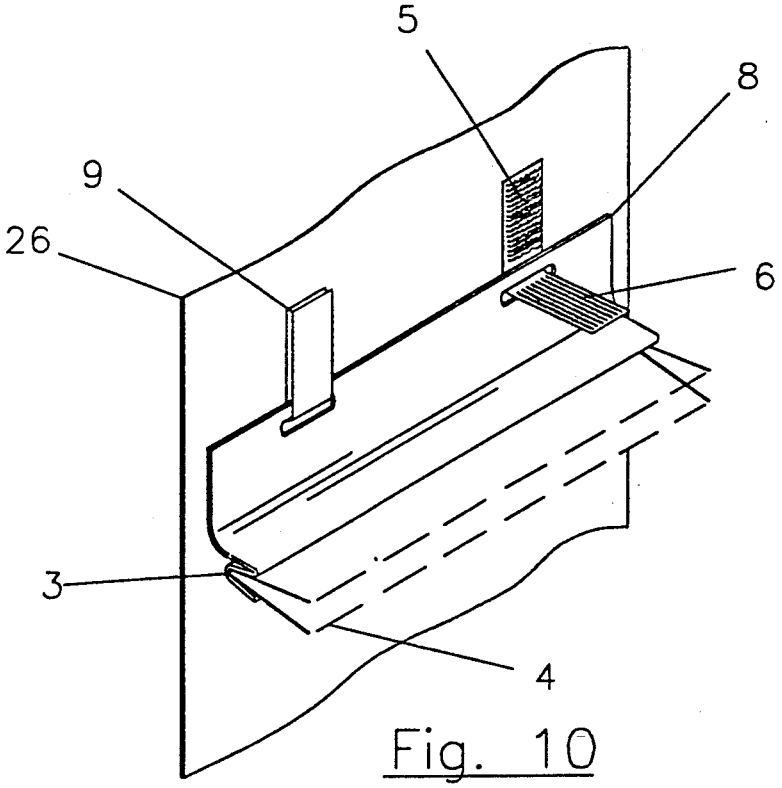
FIG. 10 is an isometric view of a typical brush and connections on a section of main belt.

FIG. 10 shows a connection of a typical brush to the endless belt. Rigid vinyl sheet heat-forms into a L-shaped angle 8 generally extending the width of the endless belt. The long leg of the angle is punched with a plurality of narrow slots designed to accept strips of hook and loop material. Prior to forming the main angle a series of bends is placed in the opposite edge to form a slotted edge to accept the brushing bristles. The slot is left open an appropriate angle and with the slot held firmly in a horizontal position with the mouth upward, bristle material is laid across the opening in appropriate densities to produce a suitable brush. With a cord held tautly above the bristles and parallel with the slot, the fixture moves the slotted edge of the plastic sheet 8 upward. This movement against the fixed cord forms the bristles into a V-shaped trough to which can be added an appropriate bead of hot melted glue. Immediate application of hot forming dies are then applied to the rigid vinyl sheet to close and encapsulate the bristles, cord and glue. The sheet is then formed into an L-shaped cross-section with a generous angle. Although it is referred to as 'rigid', the vinyl sheet is quite spring-like in thin sheets. Bristles may be made of any material from natural fibers to brass or steel wire. The latter, however, would require protective polyurethane sheet be installed with the bristles to protect the enclosure from wear.

Hook and loop strips are shown glued to the endless belt in FIG. 10. Each strip is covered on one side with looped material toward the upstream end and hooking material on the opposite end. The back side of the loop covered end is treated with pressure-sensitive adhesive. This side is pressed to the endless belt in rows so as to provide for attaching the required number of brushes. The angle 8 is attached to the belt by inserting the free end, the end covered by hooks, through the slots of the angle and pressed back upon itself. The hooks of the strip should then be in contact with the loops of the strip thus securing the angle to the belt.

Figure 11:
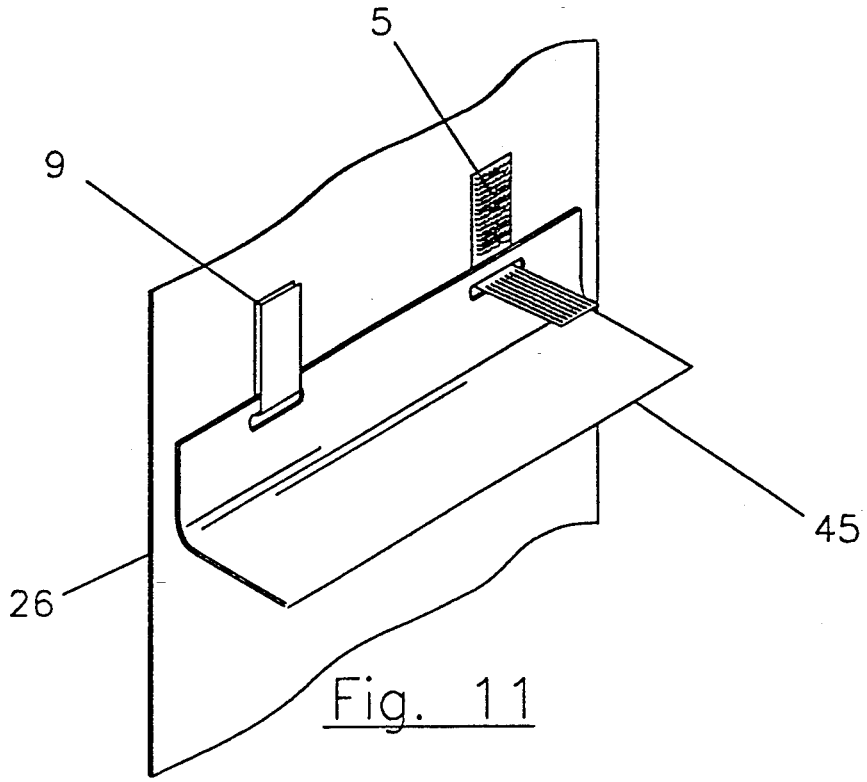
FIG. 11 is an isometric view of a typical scraper and connections on a section of endless belt.

FIG. 11 illustrates a scraper 45. It is constructed of flexible sheet material formed into a L-shaped cross-section with connecting slots placed along the edge of the short leg.

The motor 31 drives the pulley 20 by friction of an endless, circular cross-section drive belt 35 pressed into an annular V-groove 24 cut into the inner cylinder wall of the main pulley 20. Through a triangular arrangement of small pulleys 36 around a central pulley 37, which is set to the motor shaft, the drive belt 35 forms a letter A with the small pulleys forcing the drive belt 35 into the groove 24 of the main pulley. The motor 31 is screwed to a triangulated sheetmetal plate 33. The plate is then attached with standoffs to the left housing 10. A dissimilar matched plate 34 is provided for simple support of the pulley shafts 40. Slots 42 in the matched plates 33 and 34, allow adjustment of the drive belt tension and normal frictional force. The opposite end of the pulley 20 is journaled to the opposite housing 11.

Figure 8:
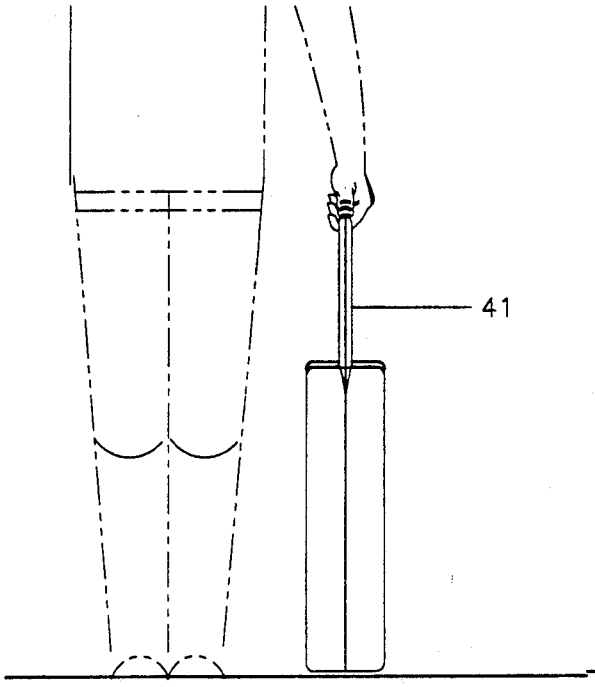
FIG. 8 is a front view of a stretched, floor sweeping version of the brush of FIG. 1, shown with an operator.
Figure 9:
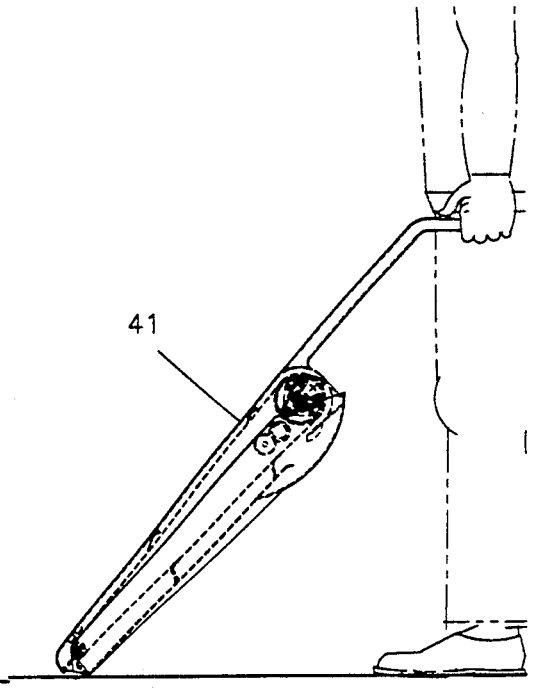
FIG. 9 shows a side view of FIG. 8.
Figure 6:
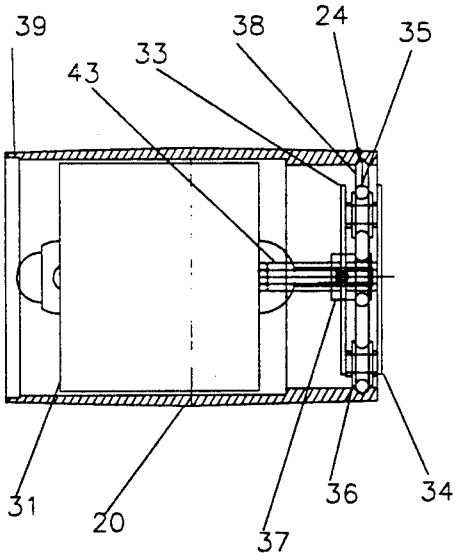
FIG. 6 is a cross-section of the driver pulley showing the motor and rotary transmission.
Figure 7:
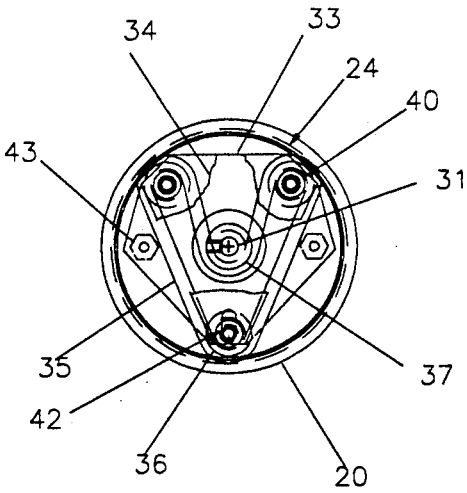
FIG. 7 is an end view of FIG. 6.

FIG. 8 and FIG. 9 illustrate a stretched version 41 of the previously described cleaner. The only difference, other than length, is more brushes are required to produce the same cleaning the strokes per unit of time.

Figure 2:
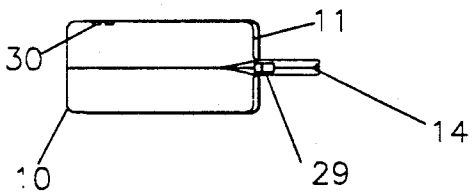
FIG. 2 is a top view of FIG. 1.
Figure 4:
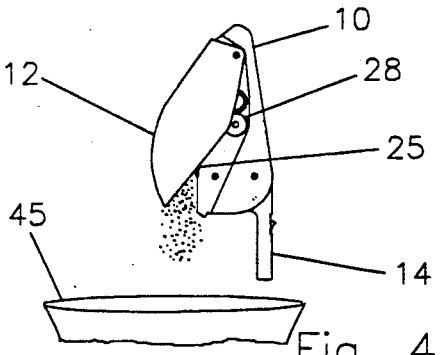
FIG. 4 is a side view of the brush of FIG. 3 being emptied.
Figure 1:
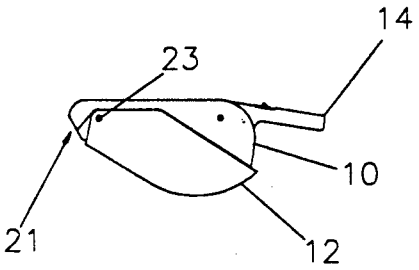
FIG. 1 is a side view of a battery operated, endless belt brush sized for cleaning car interiors, furniture, etc..

OPERATION—FIGS. 2, 3 and 4.

A separate flat plate acts as an apron upon which the dust is conveyed to the dust pan 12. As the brushing unit is tipped forward the apron works to block captured refuse from escaping.

FIG. 3 is a side view broken away to show the drive pulley 20, the driven pulley 22, the endless belt 26 and the power supply 28. The vinyl angle 8 is somewhat straightened by the space surrounding the driver pulley 24 just after passing through the comb 25. Brush 17 is also in a compressed position. Brush 18 is just entering the work stroke while brush 19 is approaching the end of the conveying stroke. Brush 23 is merely included to shown motion, showing brush 18 an instant later.

FIG. 3 shows four brushes. The number used in a design depends on speeds attained by the motor and belt ratios and the number of brush strokes desired per unit of time. There may be only one brush or many. It is a choice the designer must make. Four are used in this design as the motor runs at 2350 RPM and the ratios yield four revolutions per second of the main belt 26.

Assuming the operator moves the unit forward and back once per second and moves eight inches each way, then a brush sweeps through at every inch of action of the unit. The sweep opening is approximately 2 inches. Therefore every lineal inch of surface is fully brushed twice each way. A reasonable choice. Stretching the unit and belt lengthwise and using the same motor as in FIG. 8 and FIG. 9, the cleaner 41 would require additional brushes to achieve the same effect.

The eccentric location within the enclosure of the two pulleys 20 and 22 serves three purposes. One is to enable reduction of overall size and another is to straighten out the L-shaped brushes and thus store energy. The third and most important reason is to provide a tautness to the belt. As the brush emerges into the working opening it snaps back from the forced shape (nearly straight) to its free shape (the L-shape). This snapback adds to the tip velocity of the brush bristles allowing more vigorous brushing speed at the opening. Likewise with the scrapers.

The location and shape of the pan and apron allows cleaning surfaces over a wide range of inclinations from straight up, to horizontal, to straight downward. Air is dragged along with each brushstroke. The air has nearly the same velocity as the brushes thus giving some of the effect of a regular vacuum machine but without using nearly as much power. As the brushes come up the apron of the pan they are again squeezed thus storing elastic energy. When the brush reaches the end of the apron this energy is released. The brush tip sweeps an arc downward into the pan space. Dust particles are thrown off in tangential directions. The brushes, finally, encounter a toothed comb further encouraging the particles within the brush to drop out and enter the pan.

FIG. 4 shows the unit in position to discharge refuse from the pan. To open the pan for discharging the operator applies pressure to the lip of the pan 12 in a direction away from the handle. Gravity empties the pan.

In order to change batteries the pan is revolved an additional amount to where the sides of the pan clear the battery housing tubes 28.

Figure 5:
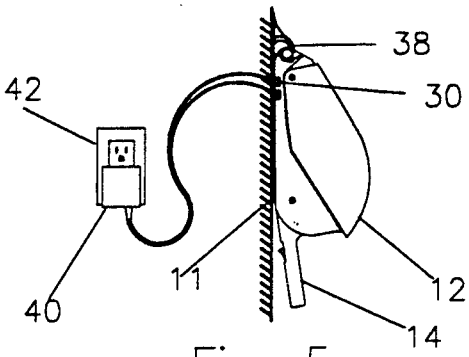
FIG. 5 is a side view of the previous brush hanging on a wall for storage and recharging.

FIG. 5 illustrates a wall hanger 38 for storing the unit on the wall. Upon insertion, contact is made between the charging contacts 30 of the sweeper unit and the matching contacts of the wall hanger. The matching contacts of the wall hanger are wired to a transformer 40 which is plugged into a 110 volt outlet 42 on the storage wall.

SUMMARY, RAMIFICATIONS, AND SCOPE OF INVENTION

Accordingly, the reader will see that the powered endless belt brush of this invention can be used to sweep a wide variety of surface textures in a wide variety of inclinations very efficiently with a minimum of power and noise. In addition, it can be very effective in picking up and retaining a broad variety of materials from dust particles to broken glass which would be a real test for a vacuum cleaner or carpet sweeper. Furthermore, the powered endless belt brush has the additional advantages in that

- it can be easily relieved of its load of refuse requiring no external bag;
- it can always be operated intermittently at peak power;
- power is required only to overcome brushing friction and friction within the system and therefore the requirement is very low.
- the operator can sweep an entire surface regardless of structures or shapes in the immediate area as the brushing action is not contingent on moving the unit;
- it is a very adaptable design allowing configuration changes by merely changing dimensions of width and length between centers of the main endless belt.

Although the description above contains many specificities, these should not be construed as limiting the scope of the invention but as merely providing illustrations of some of the presently preferred embodiments of this invention. For example the brushing tools could be held on with hook and loop material for quick and easy replacement or exchange of brushing and scraping tools. For instance, the brush bristles can be removed and replaced by extensions of the plastic carrier, thus making elastic scrapers instead of brushes. A combination of brushes and scrapers may be excellent in certain environs. For another example, a small wider version with a large pan may be excellent in a machine shop keeping chips cleaned from around cutting equipment. A combination would be excellent. Another place where this machine would work very well is in a restaurant. The narrow long brushing unit shown in FIGS. 8 and 9 would clean up crumbs from around tables and booths quickly and quietly without bothering patrons in the area. A wide long version with combinations of brushes and scrapers could be used on new construction sites or on concrete floors of repair shops.

Thus the scope of the invention shall be determined by the appended claims and their legal equivalents, rather than by the examples given.

I claim:

1. A powered endless belt brush comprising: an elongated enclosed housing having a top wall, side walls, bottom wall and a closed end wall having a handle mounted thereon, said housing having an opening extending across the end of said housing opposite said closed end, a portion of said top wall adjacent said end opening curved downwardly toward said opening, said housing having a greater height dimension adjacent the closed end than at the end having said opening, a large hollow pulley means rotatably mounted in said housing adjacent the closed end and extending between the sidewalls thereof, a smaller pulley means extending across said housing adjacent said end opening, motor means mounted within said large pulley means and engaging said large pulley means to rotate said large pulley means, an endless belt means extending around said large and smaller pulley means, a plurality of spaced fastening means on said endless belt means, said fastening means attaching alternating rows of brushing means and scraping means to said endless belt means, an opening extending across the bottom wall substantially midway between said pulley means, a dust pan having side and bottom walls and extending along the bottom wall of said housing, a first end of said dust pan pivotally mounted on said housing adjacent said end opening and forming with said housing a debris receiving enclosure, said bottom wall opening positioned in communication with said dust pan, a second end of said dust pan having means engaging said housing adjacent the closed end thereof to retain said dust pan in a closed position, power supply means for said motor means mounted within said housing, whereby when said lower end opening of said housing is in contact with a surface to be cleaned the brushing means engages the surface and conveys debris through said end opening onto the surface of the housing bottom wall and to said bottom wall opening and into said dust pan.

2. The powered endless belt brush of claim 1 wherein said brushing means comprising a brush formed of substantially flexible sheet material having bristles mounted thereon and extending a distance across the width of said belt means, each said sheet formed substantially L-shaped with the long leg having openings therein for reception of said fastening means to attach said sheet to said belt means, and the other said leg having said bristles extending therefrom.

3. The powered endless belt brush of claim 1 wherein the brushing means comprising scrapers consisting of substantially flexible sheet material extending a distance across said belt means, each said scraper formed substantially L-shaped with the long leg having openings therein for reception of said fastening means to attach said scraper to said belt means the other said leg ending in a plain straight edge.

4. The powered endless belt brush of claim 1 wherein said fastening means are defined by flexible strips having engaged hook and loop portions on the ends thereof with one end of each strip attached to said belt means, the other end of each said strip extending through a respective opening in said brushing means with respective ends of said strips attached to hold said sheets to said belt means.

* * * * *